US005285979A

United States Patent [19]

Francesco

[11] Patent Number: 5,285,979

[45] Date of Patent: Feb. 15, 1994

[54] WINDING APPARATUS FOR SHEET MATERIAL WEB

[75] Inventor: Lombardini Francesco, Nibbia, Italy

[73] Assignee: Gruppo Colines SRL, Nibbia, Italy

[21] Appl. No.: 845,317

[22] Filed: Mar. 3, 1992

[30] Foreign Application Priority Data

Mar. 4, 1991 [IT] Italy ..... MI91 A 000556

[51] Int. Cl.[5] ..... B65H 18/16

[52] U.S. Cl. ..... 242/65

[58] Field of Search ..... 242/65, 66, 67.1 R, 242/67.2, 75.1, 75.2, 76

[56] References Cited

U.S. PATENT DOCUMENTS

| | | | |
|---|---|---|---|
| 3,279,718 | 10/1966 | Arterton et al. | 242/65 |
| 3,494,566 | 2/1970 | Pawelczyk | 242/56 R |
| 3,834,642 | 9/1974 | Kampf | 242/67.1 R X |
| 3,977,619 | 8/1976 | Nagata et al. | 242/67.1 R |
| 4,049,212 | 9/1977 | Yamaguchi et al. | 242/65 X |
| 4,171,107 | 10/1979 | Kayser et al. | 242/75.2 X |
| 4,343,440 | 8/1982 | Engl | 242/67.1 R |
| 4,491,283 | 1/1985 | Pav et al. | 242/67.1 R |

FOREIGN PATENT DOCUMENTS

| | | |
|---|---|---|
| 0017277 | 10/1980 | European Pat. Off. . |
| 0026335 | 4/1981 | European Pat. Off. . |
| 2632608 | 2/1977 | Fed. Rep. of Germany . |
| 2741083 | 3/1979 | Fed. Rep. of Germany . |
| 3627463 | 2/1988 | Fed. Rep. of Germany . |
| 2620117 | 3/1989 | France . |
| 55-056936 | 4/1980 | Japan . |
| 60-112555 | 6/1985 | Japan . |
| 1007983 | 10/1965 | United Kingdom . |
| 2168040 | 6/1986 | United Kingdom . |

*Primary Examiner*—John M. Jillions
*Attorney, Agent, or Firm*—Young & Thompson

[57] ABSTRACT

A winding spindle (37) is mounted on a spindle-holder lever (26), carried on a horizontally traversable carriage (16). The spindle cooperates with a calender (42) for winding a roll (B) of sheet material web (N) on the said spindle. A control device (32; 66) and a related control system control the position of the carriage, and therefore of the spindle, with respect to the calender, as the thickness of the roll increases.

The apparatus can work as a surface winding winder or as a combined center-surface winding winder.

3 Claims, 9 Drawing Sheets

WINDING APPARATUS FOR SHEET MATERIAL WEB

The invention refers to the field of handling a continuous web of sheet material, for example of plastic material, such as polymer, or paper.

Downstream of the devices for the production of such sheet material, the latter must be wound into rolls for easy handling and transport. Each roll is usually wound onto a core carried by a spindle or mandrel; often the spindle cooperates with a winding cylinder or calender having its axis parallel to the axis of the spindle. This cylinder ensures a certain pressure on the roll being formed, to ensure the evenness of the winding. The apparatuses already known for winding rolls, comprising a spindle and possibly a calender, are usually divided into three groups called centre winding winders, surface winding winders and combined centre-surface winding winders.

In the centre winding winders the spindle or central shaft of the roll is motor-driven.

In the surface winding winders the calender is motor-driven, and the spindle is idle and is rotated by contact of the calender with the winding which is being formed on it.

The combined winding winders are a combination of the previous winder systems, that is the draft on the web is a result of the combination of central draft and of dragging by surface contact. From this type of winder a further system is derived, which consists of winding through a central draft at a preset distance between the outside of the roll and the surface of the calender. Usually the two last systems exist together on the same machine.

In order to be able to realize surface winding, it is obviously necessary to apply pressure between the shaft of the roll and the contact cylinder. This can be obtained by using the weight component of the devices of the machine, and the most common solution is to mount the spindle on pivoted arms and make use of the weight of the roll itself.

One problem with these systems, however, is that the contact pressure between the roll and the calender (or in other words the "rolling force", meaning the force with which the roll presses on the calender) increases with the increase in the diameter of the roll, while it would be preferable for it to remain constant to achieve good winding with constant characteristics on all the thickness of the roll.

Various ways have been tried to make the rolling force constant.

In a known winder the weight component of the roll is set at zero due to the fact that the axle of the spindle is supported on a horizontal plane, and a determined load is applied to the roll towards the calender. However it is difficult to control this load. In addition this system cannot be transformed into a centre-surface winding system because of the difficulty of motorizing the spindle axle.

Another known winder (EP-A-0 017 277) of the surface winding type mounts the spindle on a lever, oscillating between a position against the calender and an unloading position. The rolling force is realized by making use of the weight of the roll, and a load cell is positioned on the calender and regulates the angle of the spindle-holder lever according to the detected load. In this case however the angle of incidence of the weight of the roll with respect to the cylinder is variable and this variation is neglected.

The aim of this invention is to avoid the drawbacks in the prior art and to allow precise and constant control of the rolling load between the roll and the calender. A further aim is to realize a surface winding type winder, which can easily be adapted to work with combined draft winding, both of the surface type and at a preset distance. A further aim is to realize a device which allows the roll to be ejected automatically.

The spindle is mounted on a vertically positioned spindle-holder lever, so as to cancel the effects of the weight of the roll on the rolling force; the spindle-holder lever is mounted on a carriage, horizontally traversable as the diameter of the roll increases. A load cell detects the rolling force, or a barrier photoelectric cell detects the air gap between the roll and the calender, determining consequently the shift of the carriage.

The new winding apparatus allows perfect control of the contact force between the roll and the calender, that is to say of the rolling load, independently of the conditions of the weight of the roll; it allows the automatic ejection of the roll; it can be realized both in a form suitable for surface winding operation, or in a form suitable for combined winding operation, i.e. able to operate both with surface winding and winding at a preset distance.

An embodiment preferred at present is described below merely as an example and not restrictive, with reference to the appended drawings, in which.

Figure 1:
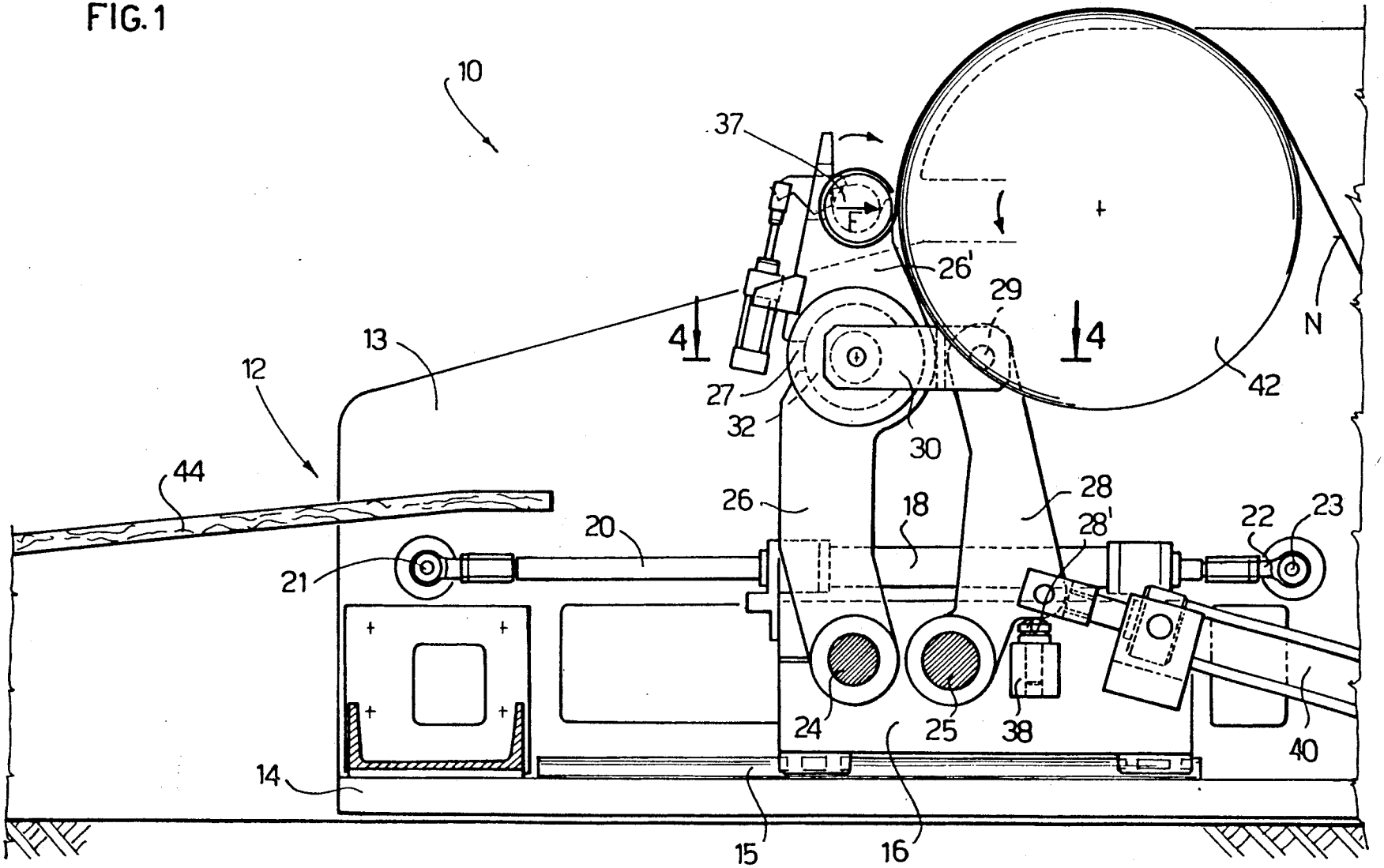
FIG. 1 is a diagrammatic vertical longitudinal sectional view along 1—1 in FIG. 7 along an apparatus in a surface winding condition or in a combined winding condition, with the roll in contact with calender, and illustrated at the beginning of winding.

The apparatus is shown as a whole with reference number 10.

It comprises a fixed framework 12, comprising a pair of vertical shoulders 13, each having a base 14. Horizontal longitudinal parallel guides are supported on both the shoulders, each consisting of an element 15, for example in the form of a rail. On each rail relative to a shoulder a carriage runs, shown at 16. Each carriage 16 is integral at the upper part with a positioning cylinder 18, whose piston (seen in FIG. 8) is integral with two opposite rods 20, 22 restrained at the ends, at 21 and 23, to the shoulders.

The carriages 16 bear two horizontal axles 24 and 25, which act as respective pivots for a pair of spindle-holder or roll-holder levers 26 and for a pair of control levers 28.

Figure 4:
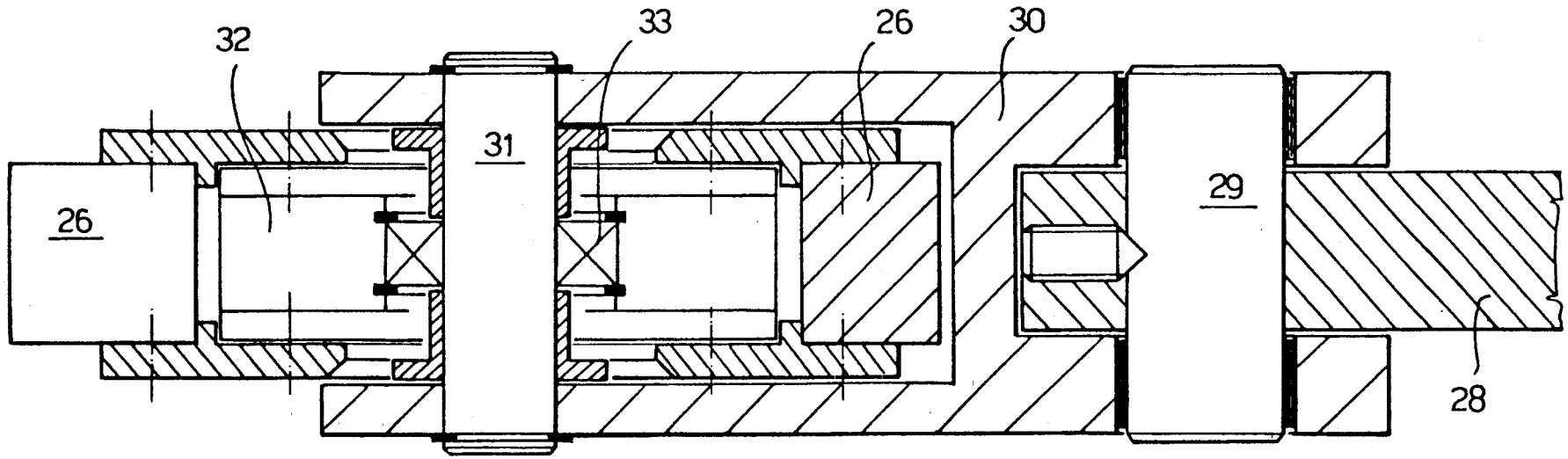
FIG. 4 is a sectional view along 4—4 in FIG. 1, illustrating the mounted load cell.

Each control lever is connected at the upper part to the related spool-holder lever by means of a control transmission arm or connecting rod 30, articulated with respect to the said levers. To be precise (see FIG. 4), each control lever 28 bears a horizontal pin 29 on which the control arm 30 is pivotably supported. This arm has a C-shaped portion, as seen in plan view, which extends towards the respective spool-holder lever, and bears a second horizontal pin 31 on the branches of the C. Between this pin and the spool-holder lever 26 a load cell 32 is mounted.

The spool-holder lever 26, which appropriately has a housing 27 for receiving the load cell, then extends upwards and forms a housing 34 (FIG. 3) for receiving the axle of a winding spindle 37.

On the upper part 26' of lever 26 a locking member 35 for the spindle axis is pivotally mounted. This member is rotatable from a locking position to a free position and vice/versa through operation of a cylinder-piston 36, which is also borne on the lever 26.

Figure 2:
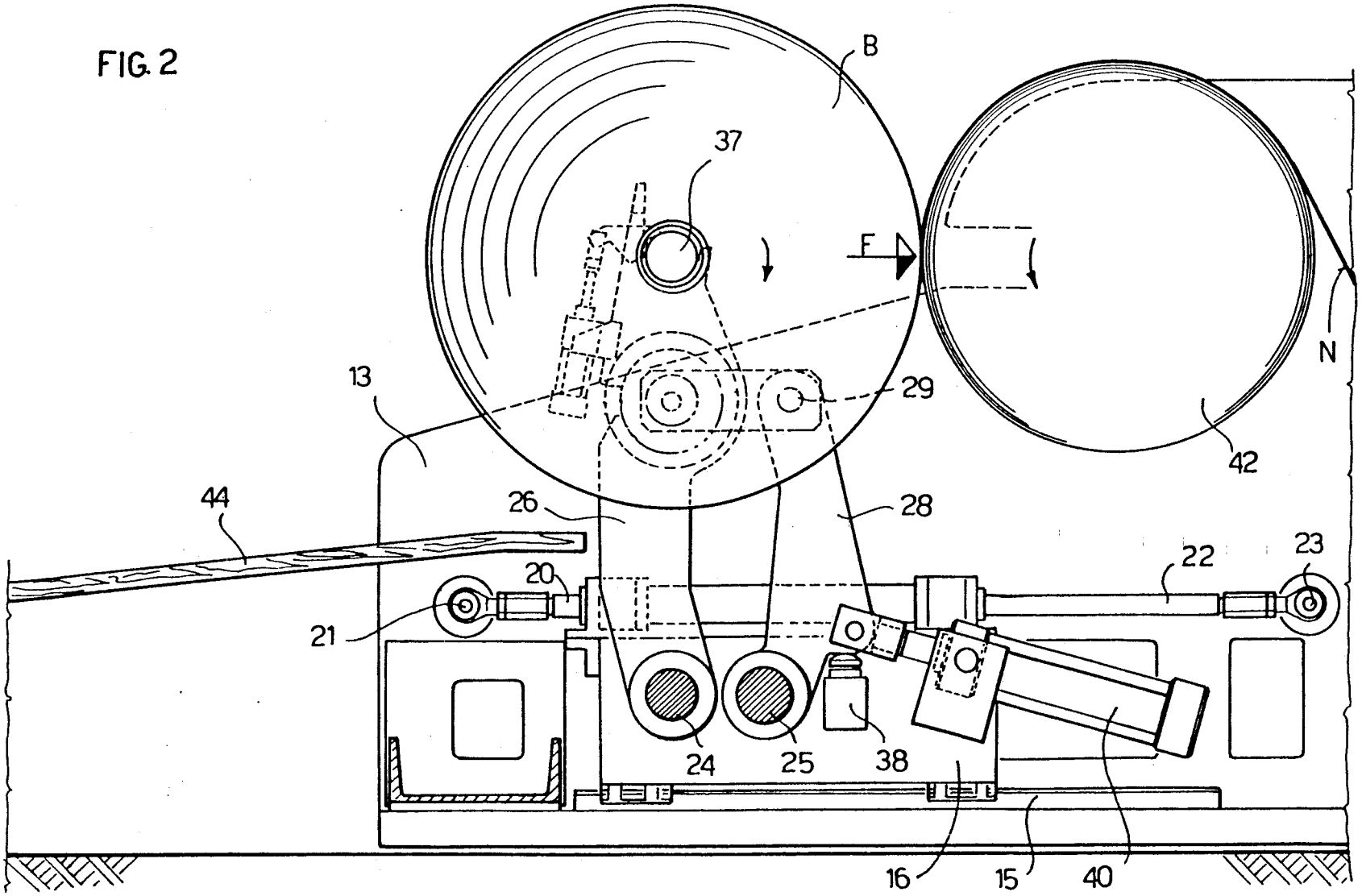
FIG. 2 is a sectional view similar to FIG. 1, which illustrates the end of winding condition (maximum diameter)
Figure 3:
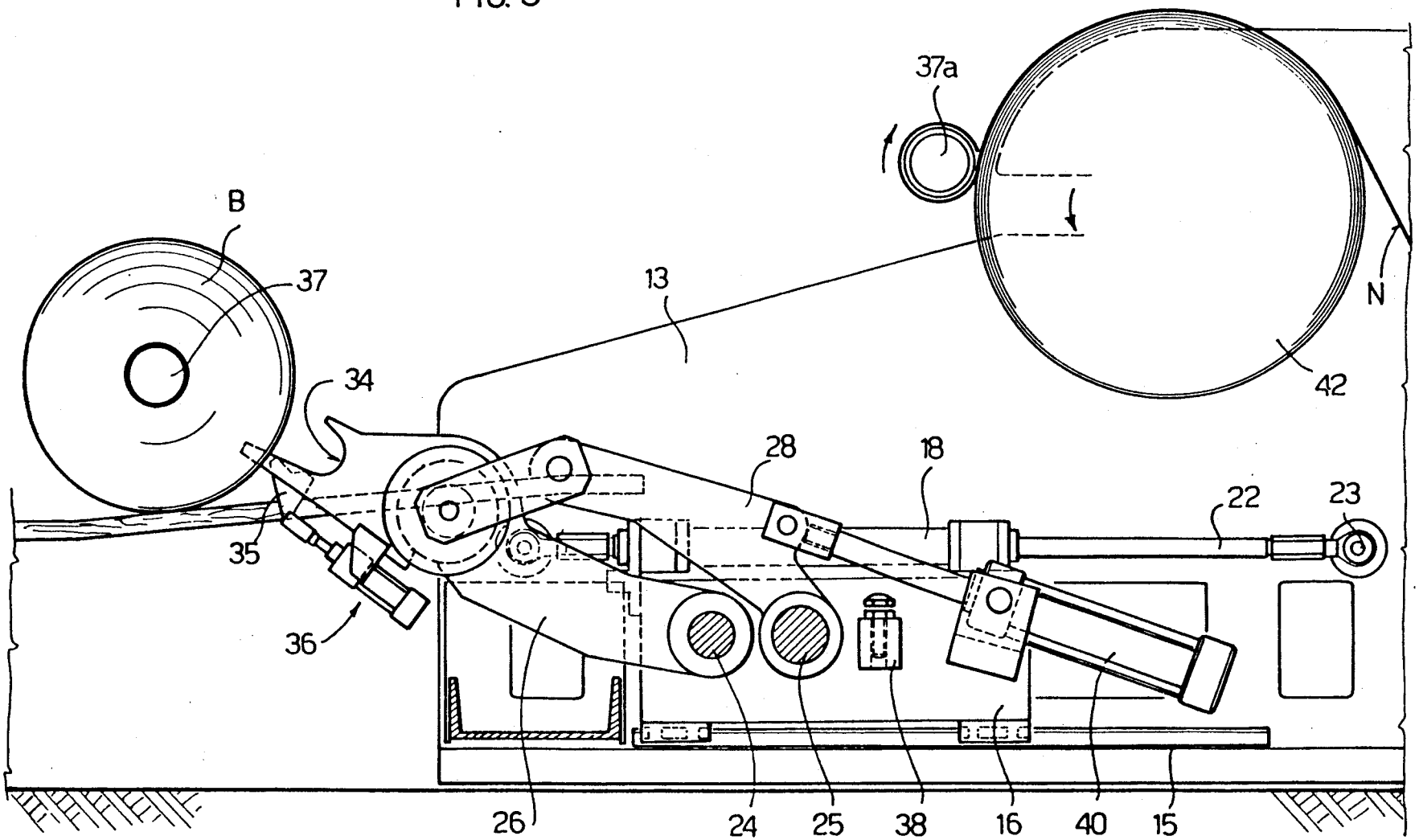
FIG. 3 is a vertical longitudinal sectional view of the apparatus in a roll unloading condition.
Figure 5:
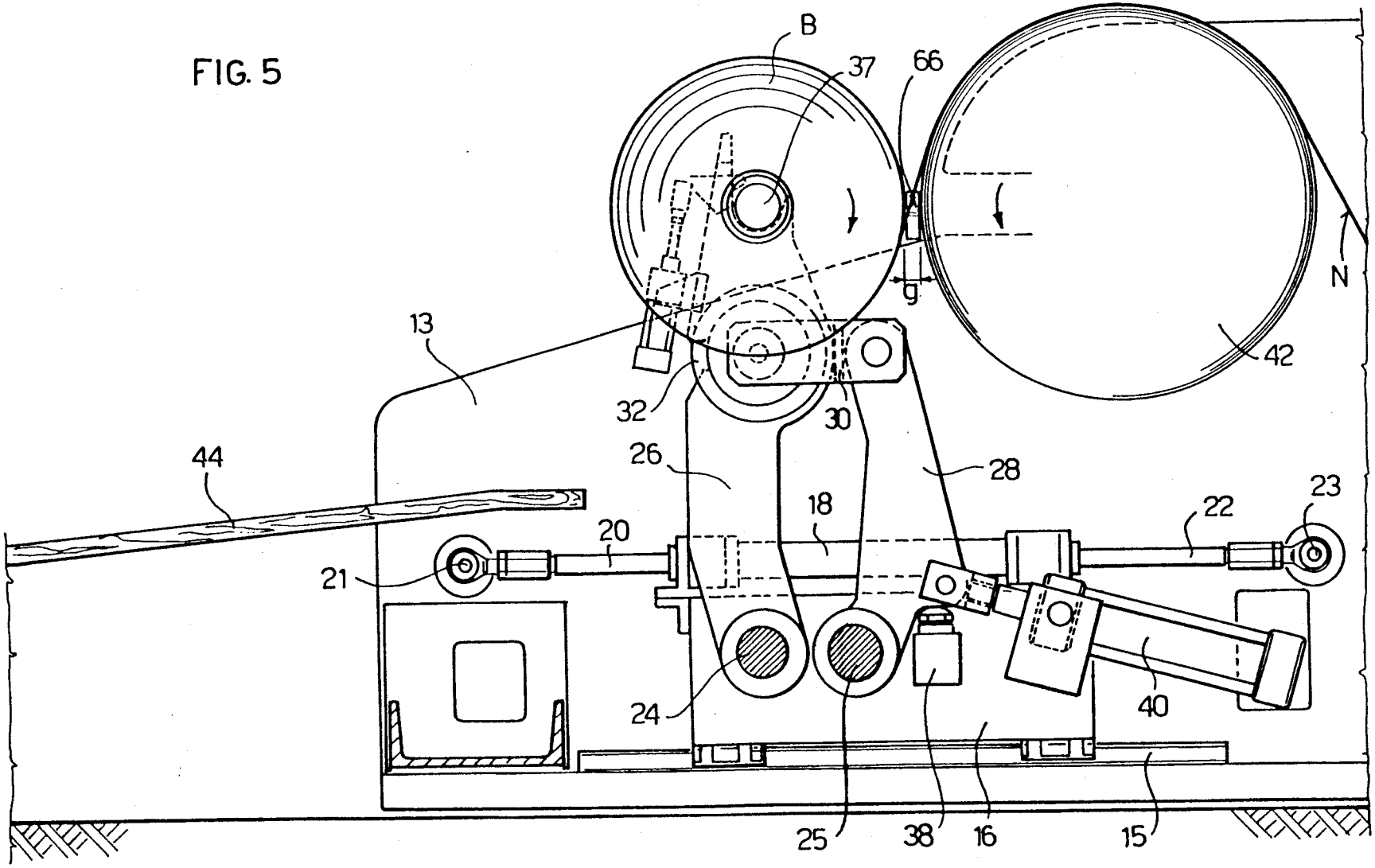
FIG. 5 is a longitudinal sectional view similar to the previous ones, showing the apparatus working in a combined or centre-surface winding condition, with a preset distance between the roll and the calender.
Figure 6:
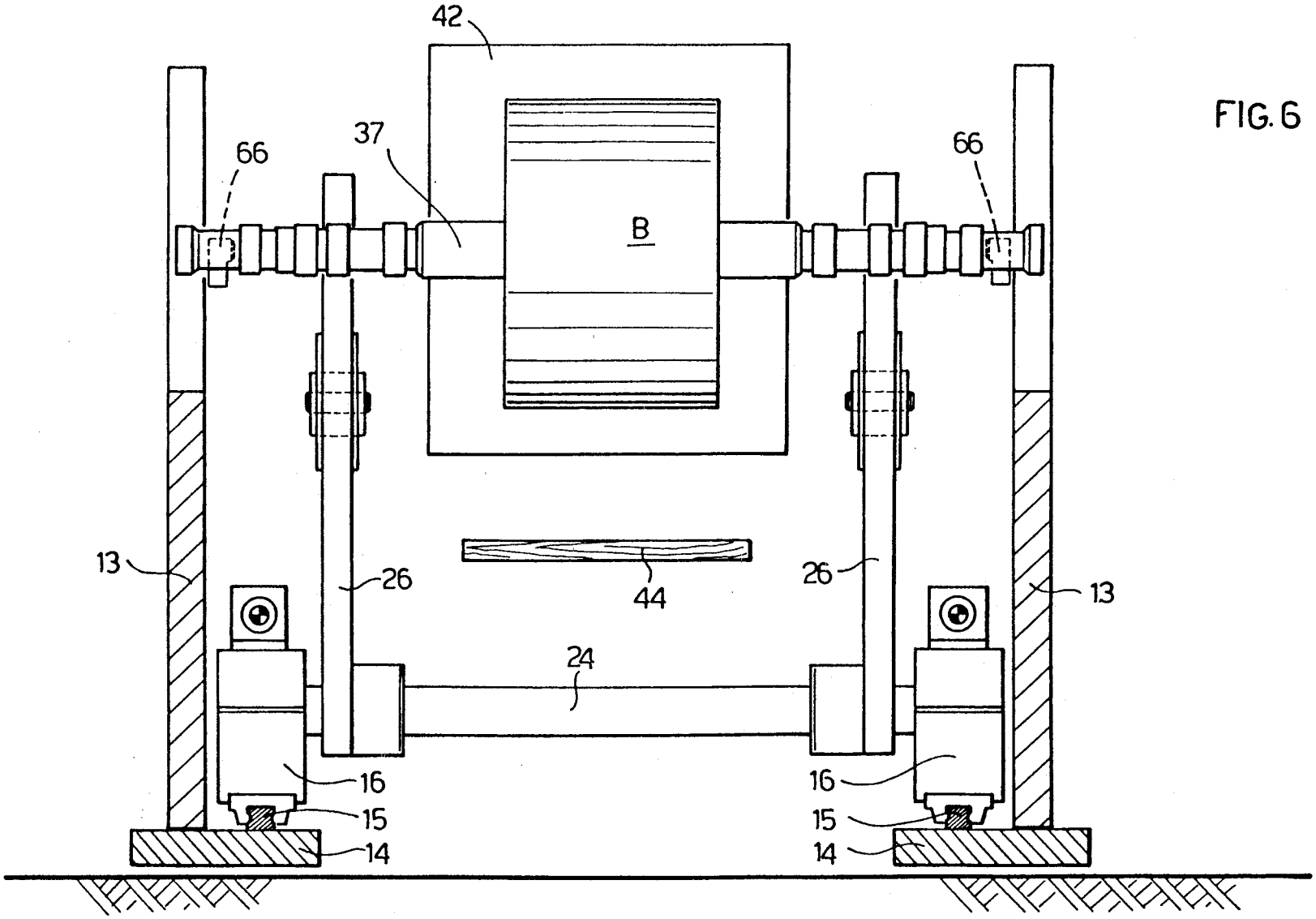
FIG. 6 is a front view, from the left of FIG. 5.
Figure 7:
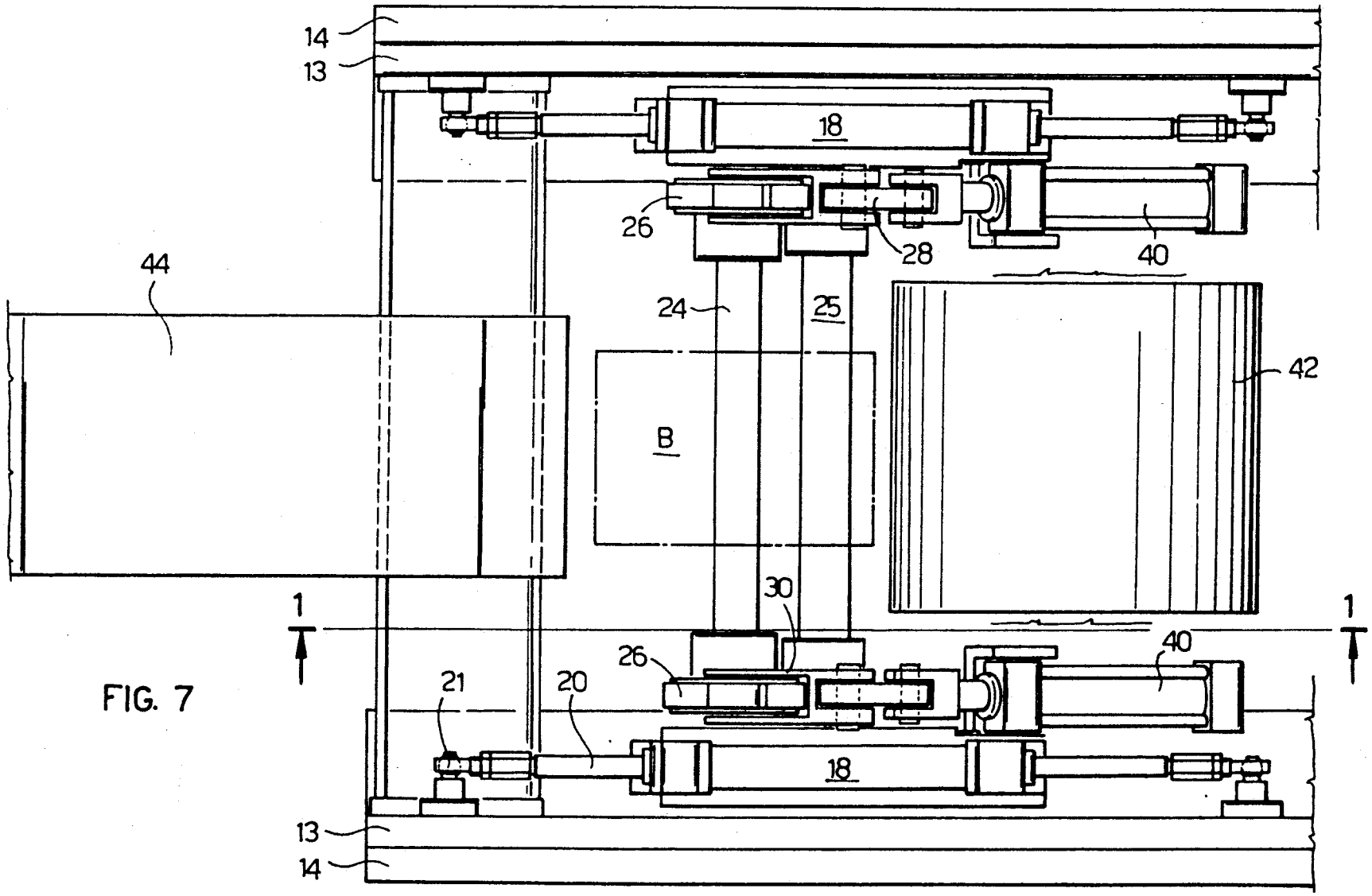
FIG. 7 is a plan view from the top of FIG. 6.

An adjustable stop member 38 is also mounted on carriage 16, and cooperates with a surface 28' on the control lever for an initial setting; an unloading control cylinder, shown with 40, is also mounted and connected with the control lever. With respect to the carriage, the pair of roll-holder levers 26 is movable between two positions; one is a winding position, in which the levers support a spindle 37 with its axis held on a vertical plane, which also contains the axis of the pivots 24 (FIGS. 1, 2 and 5), and the other is an unloading position (FIG. 3).

A calender 42 is mounted in a per se known way on shoulders 13 and its axis is coplanar with the axis of the spindle, on a substantially horizontal plane. A sloping unloading surface 44 is arranged on the downstream part of the apparatus, to unload the wound rolls.

A pair of barrier photoelectric cells 66 are arranged on the shoulders 13, in a position corresponding to the position of minimum distance between the periphery of the roll and the calender.

Figure 8:
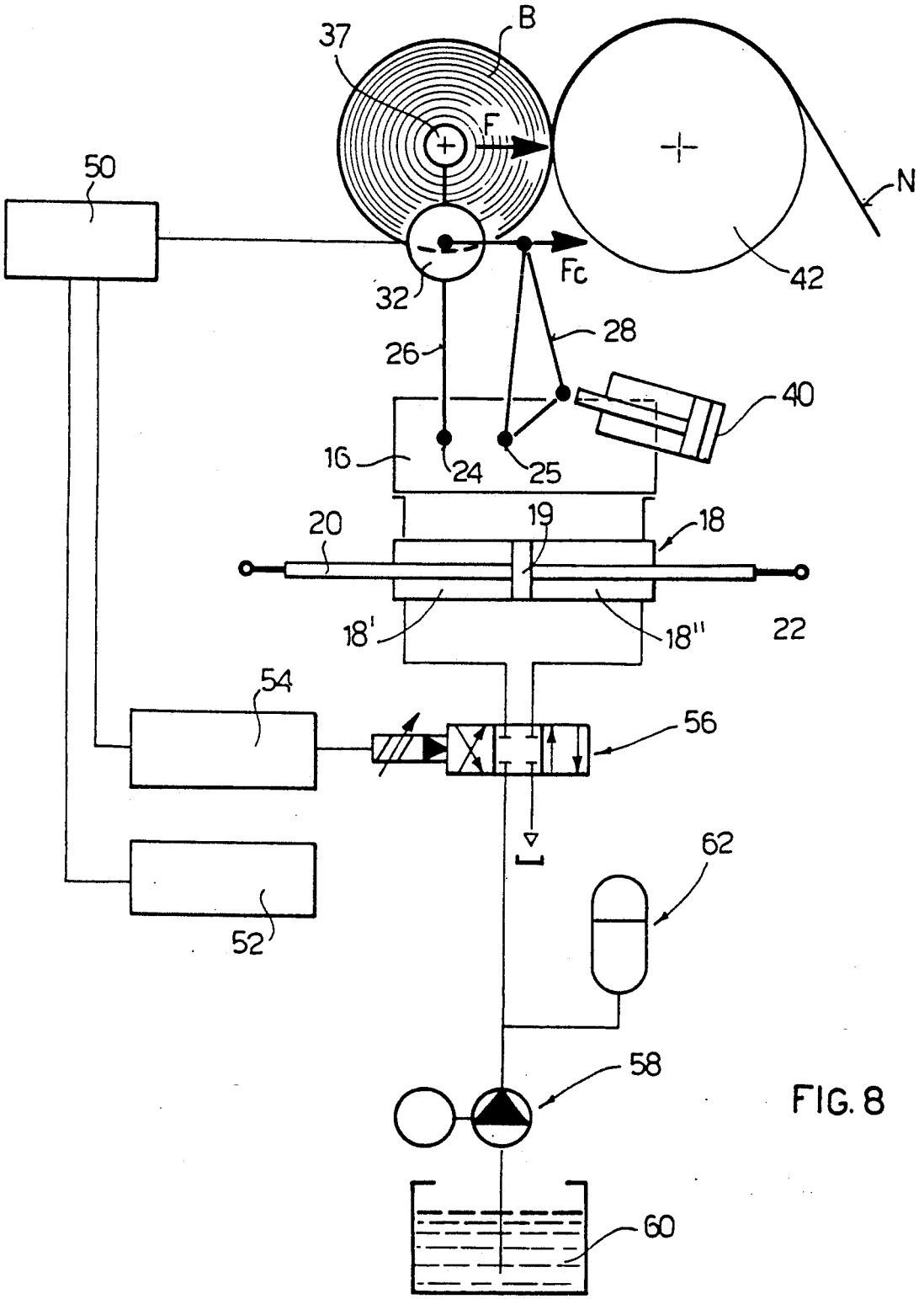
FIG. 8 is a diagram of the control circuit for operation with controlled rolling load.
Figure 9:
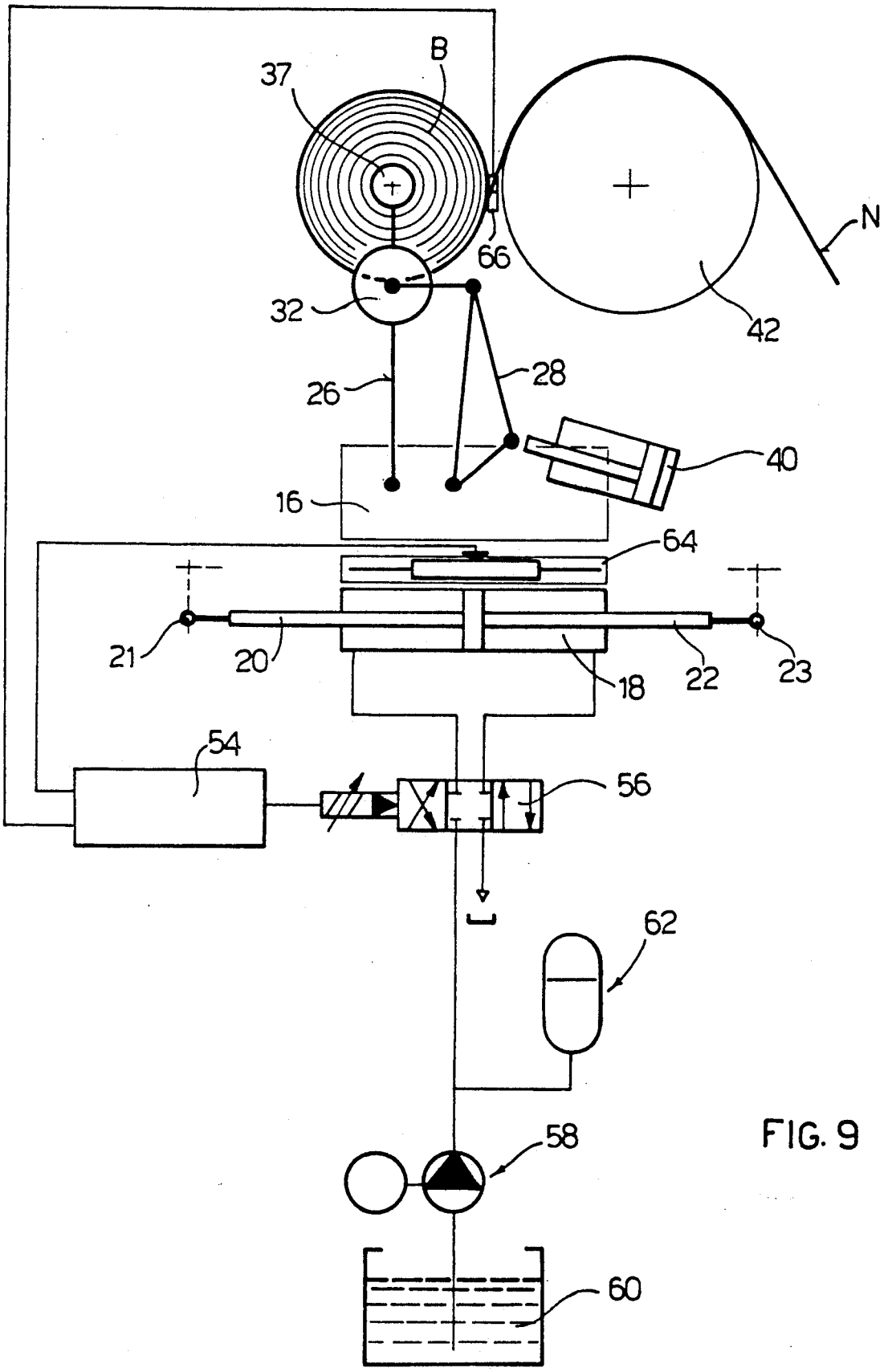
FIG. 9 is a diagram of the control circuit for operation with preset distance between the roll and the calender.

In FIGS. 8 and 9 the apparatus control diagram is shown. The load cell 32 is connected by means of an amplifier 50 to a display 52 and to a control 54; this drives a servovalve 56, which feeds one or the other chamber 18' or 18'' of the cylinder 18 by means of a motor pump 58, a tank 60 and an accumulator 62.

The photoelectric cells 66 are connected to the same control 54, to which a linear potentiometer 64 is also connected. The control 54 drives servovalve 56 which feeds the chamber 18'' of the cylinder 18 by means of motor pump 58, tank 60 and accumulator 62.

The apparatus described here can work both with only surface winding or with combined winding, that is central plus surface winding, using the load cells for control; or with combined winding with preset distance, using the barrier photoelectric cells for control. Obviously the scope of the invention includes a winder with just one of the above types of control. A description will be given below of the operation of the surface system (valid for both types of winding which can be realized) and then of the operation at a preset distance (which can be realized only in the condition of combined winding).

The operation of the system in the condition of contact winding (for both surface draft and combined draft) can be described as follows.

A first winding spindle 37 is positioned, supported in the housings or seatings 34 on the roll-holder levers 26, and it is locked with the locking devices 35, and placed in the working position (FIG. 1) against the calender. The web N passes along the calender and is wound onto the spindle.

The directions of rotation of the driving calender or cylinder 42 and of the roll B which is being formed on the spindle are shown by the arrows in the figures. The rolling load F between the roll and the cylinder produces a force $F_c$ on the load cell. This force is detected by the cell and converted into an electric signal, then amplified and transmitted to a display system and a control system. The control system, by means of a high response proportional servovalve, allows the cylinder 18, and therefore all the roll support device, to be repositioned in the conditions in which the set load F is reset.

In summary, the operator sets the load F, which is selected according to the type of production, then in the winding phase each minimum variation with respect to this set load involves re-positioning of the cylinder 18. In fact, the winding of each coil of the web involves a variation of the load F, which is immediately reset, and therefore even winding is obtained from the beginning up to maximum diameter. At the end of winding, the control functions are cut off and the carriage 16 traverses up to the outer end of its run, after which the cylinder 40 rotates the control levers 28 and consequently the roll-holder levers 26. In this way the roll is deposited on the unloading chute 44. The return of the rod of the cylinder 40, and therefore the return of the carriage 16 towards the calender 42 allows the previous winding conditions to be set with a new spindle 37*a*, which has been positioned on the levers 26 in the meantime.

The operation of the system in the conditions of winding at a preset distance (combined draft winding) can be described as follows: the system of barriage or barrier photoelectric cells 66 (with transmittor receiver), which is positioned at an area in which the contact band between the roll B and the cylinder or calender 42 is usually generated, must always stay clear or open. In fact the increase in the roll diameter tends to obscure or interrupt the barrier; when this happens, the signal coming from the photoelectric cell through the control system 54 drives the servovalve 56, which consequently modifies the position of the carriage 16 by a predetermined amount, which is detected by means of the voltage variation on linear potentiometer 64, positioned parallel to the hydraulic cylinder.

A series of small movements will be added until the barrier is open again. At this point these movements will be interrupted until the barrier is obscured again. This series of small movements can be likened to a continual traverse of the carriage at a speed equal to the growth of the radius of the roll, keeping the distance between the cylinder and the roll constant. This distance is determined by the mechanical positioning of the barrier on the machine.

What is claimed is:

1. A winding apparatus for winding a web of sheet material comprising: a winding calendar (42); at least one spindle-holder or roll-holder lever (26), for supporting a spindle (37), for winding a roll of web, the axis of the spindle being parallel to the axis of the calendar, one or more carriages (16) onto which the said holder levers (26) are mounted for horizontal movement, a detector element (32; 66) for detecting the winding, a movement means (18) for the carriage, and a control system for determining the traverse of the said carriage/s according to the increasing winding on the spindle; said holder levers (26) being pivotable on the said carriage/s (16) between an upright working or web winding position for forming a roll, and a lowered position for unloading the roll, further comprising control levers (28) pivoted on the said carriages (16) along an axis (25) parallel to the axis (24) of the pivot/s of said holder levers (26), the said control levers each being connected to a respective holder lever on the same carriage by means of an arm or connecting rod (30); the said detector element (32; 66) comprising a load cell (32) which is positioned between the said holder lever (26) and said arm (30).

2. An apparatus according to claim 1, wherein said load cell controls a servovalve (56), which in its turn controls a cylinder (18) for the horizontal movement of the carriage (16).

3. An apparatus according to claim 1, wherein the force detected by the load cell is a force related to the rolling load produced at a mutual contact area between said cylinder and roll.

* * * * *

UNITED STATES PATENT AND TRADEMARK OFFICE

CERTIFICATE OF CORRECTION

PATENT NO. : 5,285,979

DATED : February 15, 1994

INVENTOR(S) : Francesco LOMBARDINI

It is certified that error appears in the above—identified patent and that said Letters Patent is hereby corrected as shown below:

On the title page, in Item [19], change the inventor's surname from "Francesco" to --Lombardini--.

On the title page, in Item [75], change the inventor's name from "Lombardini Francesco" to --Francesco Lombardini--.

Signed and Sealed this

Twelfth Day of July, 1994

Bruce Lehman

*Attest:*

BRUCE LEHMAN

*Attesting Officer*

*Commissioner of Patents and Trademarks*